US005243309A

United States Patent [19]

L'Ecuyer

[11] Patent Number: 5,243,309

[45] Date of Patent: Sep. 7, 1993

[54] TEMPERATURE STABLE FOLDED WAVEGUIDE FILTER OF REDUCED LENGTH

[75] Inventor: Jean L'Ecuyer, Vaudreuil, Canada

[73] Assignee: GHZ Technologies Inc., St. Laurent, Canada

[21] Appl. No.: 894,297

[22] Filed: Jun. 4, 1992

[51] Int. Cl.[5] ..... H01P 1/208

[52] U.S. Cl. ..... 333/209; 333/212

[58] Field of Search ..... 333/113, 208, 212, 209

[56] References Cited

U.S. PATENT DOCUMENTS 3,008,099 11/1961 Marcatili .
3,737,816 6/1973 Honicke ..... 333/212
3,889,213 6/1975 Vittoria et al. .
4,396,896 8/1983 Williams ..... 333/212
4,761,625 8/1988 Sharma .
5,061,912 10/1991 Moeller ..... 333/113

*Primary Examiner*—Paul Gensler
*Attorney, Agent, or Firm*—Oblon, Spivak, McClelland, Maier & Neustadt

[57] ABSTRACT

A temperature stable bandpass folded filter for microwave radio communication, made from standard waveguide sections. Two waveguide sections are divided into cavities using metal plates made from a temperature stable material, to construct the filter. The sections are connected juxtaposed and the cavities of each section are coupled through holes in the coupled broadwalls of the section. Low insertion loss and very good temperature stability is obtained with the use of copper clad INVAR waveguide material. The method of constructing the temperature stable folded waveguide filter of reduced length is also disclosed.

17 Claims, 3 Drawing Sheets

TEMPERATURE STABLE FOLDED WAVEGUIDE FILTER OF REDUCED LENGTH

TECHNICAL FIELD

The present invention relates to a temperature-stable folded waveguide bandpass filter of reduced length and a method of constructing same.

BACKGROUND ART

Bandpass filters are widely used in radio communication systems. At microwave frequencies, electrical signals are often guided by transmission lines in the form of rectangular waveguides to minimize losses of the signals. Waveguide filters may be implemented using shunt inductive irises along the waveguide structure forming resonating cavities coupling to one another. Such filter design is well described in the book, "Microwave Filters, Impedance-Matching Networks, and Coupling Structures" by G. Matthaei, L. Young and E. M. T. Jones at pages 450 to 459.

One problem with waveguide filters, especially at lower frequencies, is the size or more specifically the length of the filter, which is a limiting factor when it comes to integrate them in today's compact radio systems. For example a six-cavity filter at 5 GHz is about 12-inches long. This length can be reduced by one-half when superposing every other adjacent cavity to implement a folded structure. These "folded" structures can be machined out of a block of brass or copper, but in some cases, to achieve the required temperature stability, a more stable material has to be used. Machining the filter from a block of INVAR is very difficult and expensive.

SUMMARY OF INVENTION

It is a feature of the present invention to implement a folded filter using standard copper or copperclad INVAR waveguide sections, in order to achieve size (length) reduction as well as temperature stability.

A further feature of the present invention is to provide a temperature-stable folded waveguide bandpass filter which is of reduced length while maintaining the performance characteristics of a straight folded waveguide filter which is substantially longer.

Another feature of the present invention is to provide a temperature-stable folded waveguide bandpass filter of reduced length which is easier to construct and more economical than known folded waveguide bandpass filters having a serpentine arrangement of resonating cavities machined from metal blocks.

Another feature of the present invention is to provide a temperature-stable folded waveguide bandpass filter of reduced length which is lighter than similar folded waveguide bandpass filters which are machined from metal blocks.

According to the above features, from a broad aspect, the present invention provides a temperature-stable folded waveguide bandpass filter of reduced length and comprised of two straight waveguide sections of rectangular cross-section. At least one of the sections has opposed parallel sidewalls and opposed parallel broadwalls. The other of the section has opposed parallel sidewalls and at least one outer broadwall. One end of each section is an open end and the opposite end is closed by an end wall. Connecting means is provided adjacent the open end. Each of the waveguide sections has transfer slits formed in their respective sidewalls and an outer broadwall at predetermined locations to receive therein shunt inductive iris plates and cavity wall plates to form resonating cavities in both the waveguide sections. The waveguide sections are interconnected superposed along an inner coupling broadwall of at least one of the sections thereof with the open end of each waveguide section disposed at opposed ends. The inner coupling broadwall of at least one of the waveguide sections has inductive coupling holes. Means is provided to tune the frequency of the resonating cavities.

According to another broad aspect, the present invention provides a temperature-stable folded waveguide bandpass filter of reduced length. The folded waveguide bandpass filter comprises two straight waveguide sections of rectangular cross-section each defined by opposed parallel side walls and opposed parallel broadwalls. One end of each of these sections is an open end and the opposite end is closed by an end wall. Connecting means is provided adjacent the open end. Each waveguide section has transverse slits formed in its sidewalls and broadwalls at predetermined locations to receive therein shunt inductive iris plates and cavity wall plates to form resonating cavities in both the waveguide sections. The waveguide sections are interconnected superposed along a coupling broadwall thereof with the open end of each waveguide section disposed at opposed ends. The coupling broadwall of each waveguide section has inductive coupling holes. The coupling holes in the coupling broadwall of each waveguide section is juxtaposed when the waveguide sections are interconnected. Means is provided to tune the frequency of the resonating cavities.

According to a still further broad aspect of the present invention there is provided a method of constructing a temperature-stable folded waveguide filter of reduced length while maintaining the performance of a straight waveguide filter which is substantially longer. The method comprises the steps of providing two straight waveguide sections of rectangular cross-section and at least one having opposed parallel sidewalls and opposed parallel exterior and interior broadwalls, and the other having opposed parallel sidewalls and at least said exterior broadwall. One end of each section is an open end and the opposite end is closed by an end wall. Connecting means is provided adjacent the open end. Transverse slits are formed in the respective sidewalls and the exterior broadwalls of the waveguide sections at predetermined locations. Shunt inductive iris plates and cavity wall plates are secured in the slits to form resonating cavities in both the waveguide sections. Inductive coupling holes are formed in the interior broadwall of at least the waveguide section having opposed broadwalls at predetermined positions. The waveguide sections are interconnected by superimposing the waveguide sections in a predetermined manner with the outermost of the exterior broadwalls and connecting them together with the open end of each section at an opposed end.

BRIEF DESCRIPTION OF DRAWINGS

A preferred embodiment of the invention will now be described with reference to the accompanying drawings, in which.

DESCRIPTION OF PREFERRED EMBODIMENTS

Figure 1:
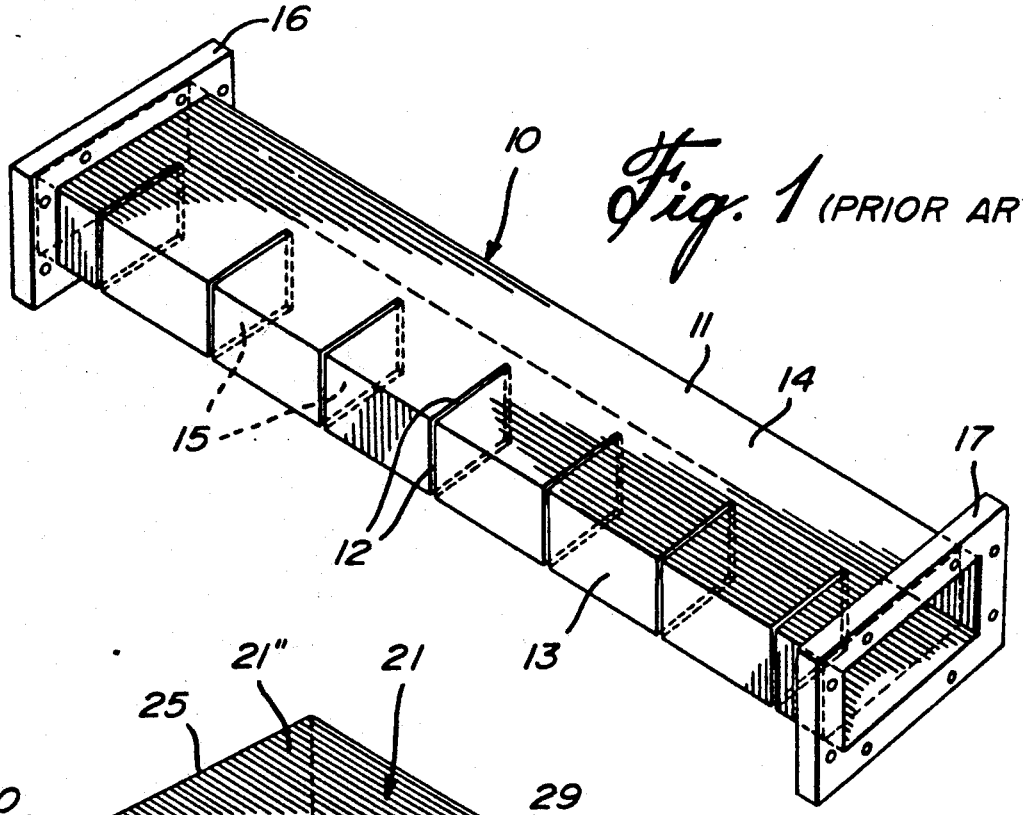
Fig. 1 (PRIOR ART)
FIG. 1 is a perspective view of a standard waveguide bandpass filter equipped with inductive iris plates to form serially disposed resonating cavities.

Referring to FIG. 1, there is shown generally at 10 a straight standard waveguide bandpass filter of the prior art. It comprises a waveguide tube 11 having slits 12 formed in a sidewall 13 and broadwall 14 thereof. Inductive iris plates 15 of various lengths are positioned within the slits and secured therein. The filter is open at opposed ends and provided with an input securing flange 16 and an output securing flange 17 to interconnect the waveguide to associated electronic radio communication hardware (not shown). A disadvantage of such bandpass filters is that they require a long space for their installation, particularly at lower microwave frequencies, and this is sometimes undesirable.

Figure 2:
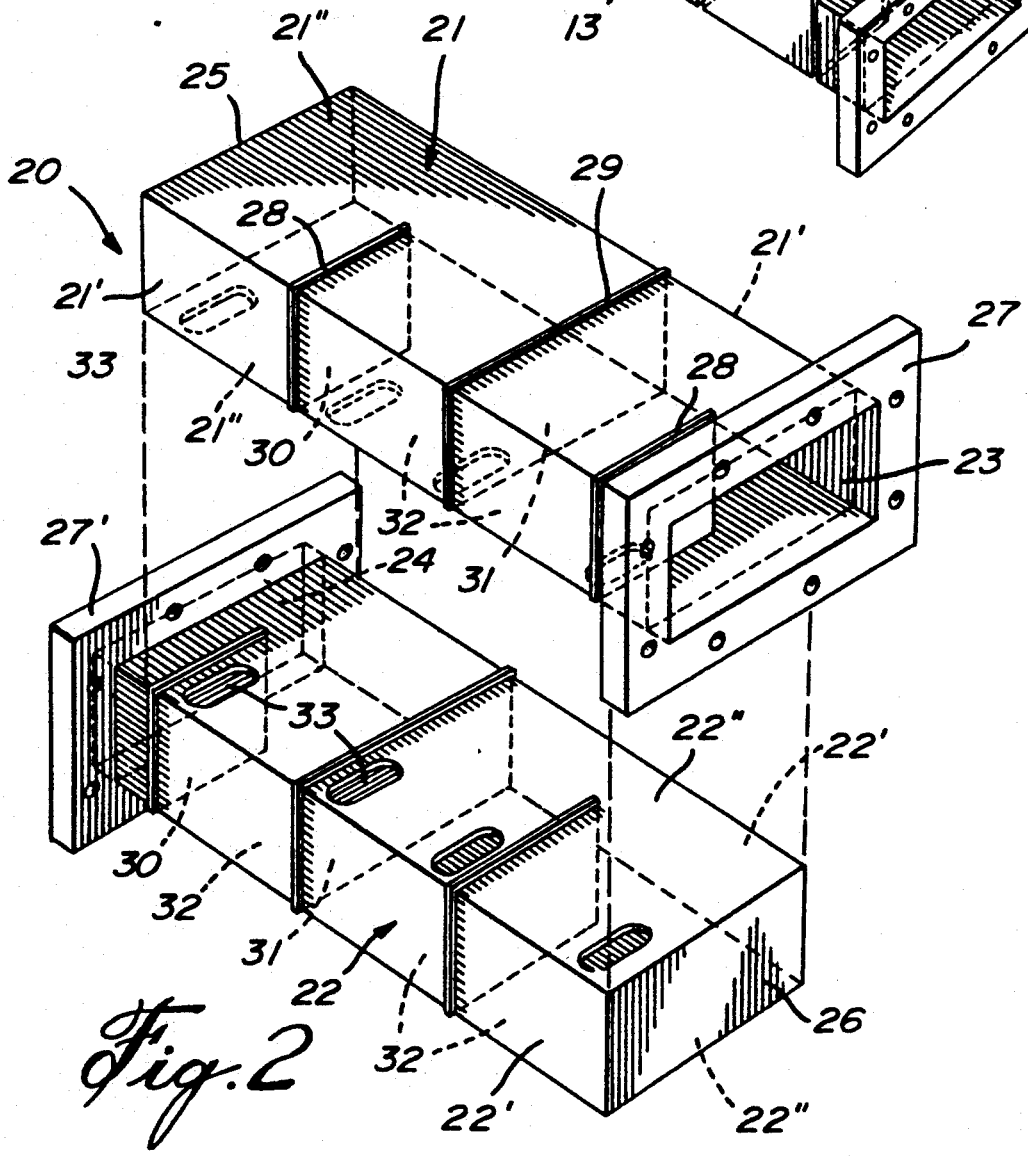
FIG. 2 is an exploded perspective view of the filter of the present invention showing the position of the iris plates and the division walls as well as the coupling holes in the waveguide section.
Figure 3:
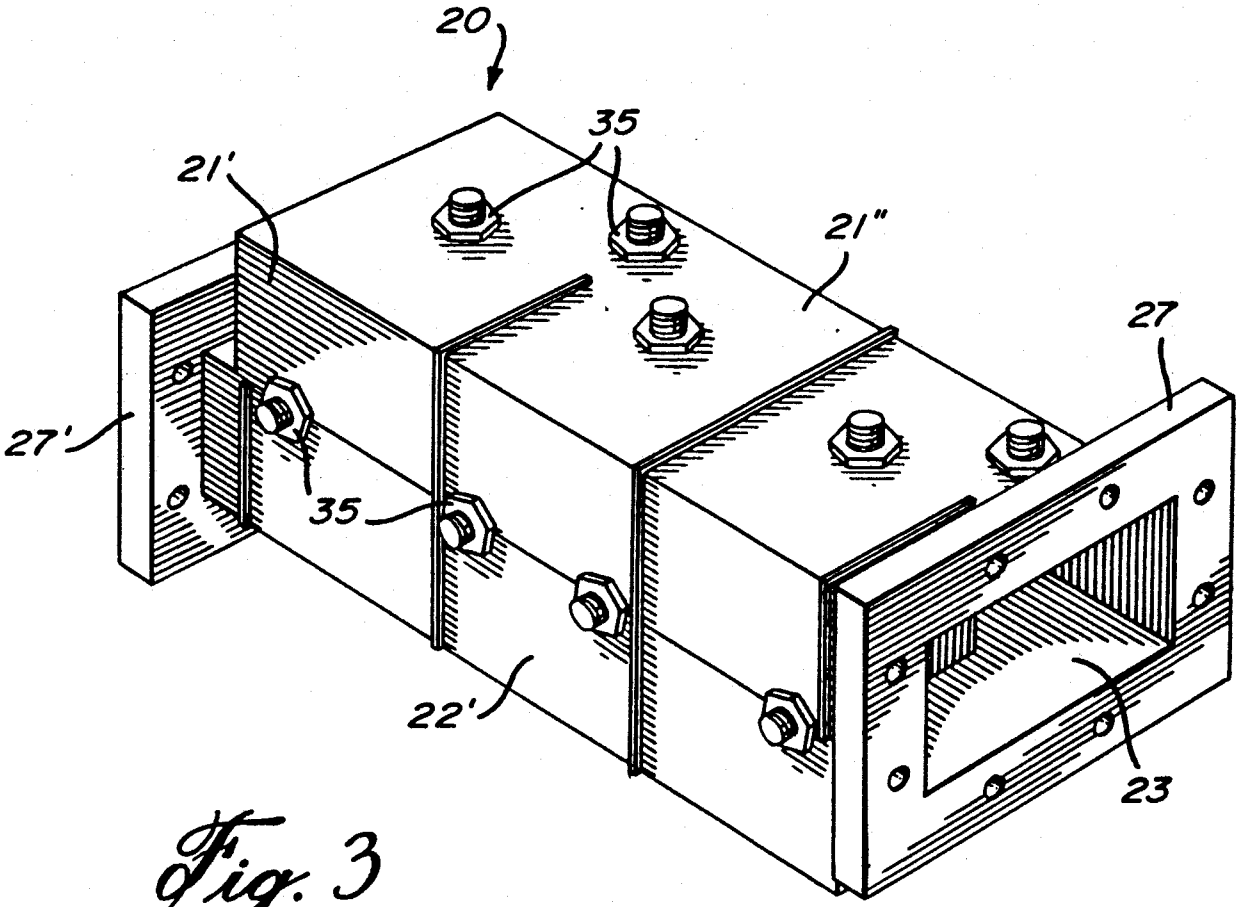
FIG. 3 is a perspective view of the six-cavity folded waveguide filter of FIG. 2 with the two superposed waveguide sections, and showing the tuning screws relative to the position of the irises to control the frequency and coupling factors.

Referring now to FIGS. 2 and 3 there is shown the construction of the temperature-stable folded waveguide bandpass filter 20 of the present invention. The folded waveguide bandpass filter is comprised of two straight waveguide sections 21 and 22. Each section is of a rectangular cross-section, and is defined by opposed parallel sidewalls 21' and 22', respectively, and opposed parallel broadwalls 21" and 22", respectively. One end of each of the waveguide sections is an open end 23 and 24, respectively, and the opposite end is provided with an end wall 25 and 26, respectively. A connecting flange 27 and 27' is also provided about the open ends 23 and 24, respectively, to interconnect the folded waveguide. When the waveguide sections are interconnected as shown in FIG. 3, one of their broadwalls is an outer broadwall and the superposed broadwalls are the inner broadwalls.

As clearly shown in these Figures, each of the waveguide sections 21 and 22 have transverse slits 28 and 29 formed transversely in one of their sidewalls 21' and 22' and one of their broadwalls 21" and 22". Transverse slit 29 extends across the broadwall while transverse slit 28 extends only a predetermined distance across the broadwall, and this is to receive shunt inductive iris plates 30 in the slits 28 and cavity wall plates 31 within the slits 29, the latter to segment the inner space of the waveguide sections, and to form resonating cavities 32 in both the waveguide sections.

One of the broadwalls 21" and 22" of each waveguide section 21 and 22 are provided with coupling holes 33 which are positioned at predetermined locations with respect to the cavities 32. These holes are elongated rectangular holes having rounded ends and are of a predetermined size to provide the proper coupling of the resonating cavities. These holes 33 are formed in a coupling broadwall of each of the waveguide sections.

The shunt inductive iris plates 30 and the cavity wall plates 31 are soldered or brazed in position along the slits 28 and 29 respectively. This soldering or brazing is effected with care, and the surface of the broadwall and side wall, where the slits are positioned, is polished so that this interconnection is flush with at least the coupling broadwall which is intended to be interconnected.

As shown in FIG. 3 the coupling broadwalls 21" and 22" having the coupling holes therein are positioned juxtaposed with one another with the coupling holes in alignment. This can be done by suitable aligning pins (not shown) to provide substantially perfect alignment of the holes 33. The open ends 23 and 24 of the waveguides are positioned at opposed ends of the juxtaposed sections, and these sections are soldered or brazed with one another to form the folded waveguide 20 of the present invention.

It is pointed out that one of the waveguide sections 21 or 22 may not have a couping broadwall so that when the sections 21 or 22 are connected, a single coupling broadwall serves as a mutual coupling broadwall.

The shunt inductive iris plates 30 and cavity wall plates 31 are preferably, but not exclusively, formed from a metal identified by the Trademark "INVAR". The end walls 25 and 26 of the sections 21 and 22 are also formed by plates of INVAR metal soldered or brazed to the waveguide tube sections. These INVAR plates provide for temperature stability and material compatibility of the waveguide. To reduce losses caused by solder joints of the INVAR plates forming the irises, copper or precious metal plating can be used to cover the inside of the filter. Each cavity and coupling aperture is adjusted with a silver-plated stainless steel screw 35 which is positioned in the broadwalls and the sidewalls of the waveguide sections to optimize the filter performance.

As shown in FIG. 2, the center cavity has two coupling holes. This dual coupling system permits to have two identical waveguide sections thus reducing the number of different parts and simplifying the assembly. This approach is not possible with a single hole, since the hole cannot be positioned in the center of the cavity due to electrical properties of the coupling structure. The connecting flanges 27 and 27' are also constructed of INVAR material to mate to associated radio interface circuitry.

As can be seen from the six-cavity structure defined by the two juxtaposed waveguide sections, shown in FIGS. 2 and 3, each waveguide section delineates two cavities in the space defined between the end walls 25 and 26 and the intermediate cavity wall plate 31 and in the space defined between the intermediate cavity wall plate and the open ends 23 and 24. The two cavities are delineated by the position of one of the iris plates 30. The cavity defined between the iris plate and the intermediate cavity wall in the space between the end wall and the intermediate cavity wall has two coupling holes in their broadwall. Once these cavities are coupled together and after juxtaposing the sections, the tuning screws 35 are adjusted to tune the frequency of the resonating cavities. Accordingly, it can be seen that the signal will follow a serpentine path through these juxtaposed waveguide sections to form a folded waveguide wherein the signal path is equivalent in length to a much longer straight standard waveguide bandpass filter, as shown in FIG. 1.

The invention also envisages the method of constructing the temperature-stable folded waveguide filter of reduced length while maintaining the performance of the straight waveguide filter shown in FIG. 1. The method comprises providing the two waveguide sections of a construction described herein with transverse slits formed therein and inductive iris plates and cavity wall plates secured in these slits with the coupling holes aligned and the waveguide sections interconnected to one another on juxtaposed coupling broadwalls. As earlier stated, one of the waveguide sections may be void of a coupling broadwall.

The filter is implemented following a design method known in the art, and as described by Matthaei G., L. Young, and E. M. T. Jones, in the publication "Microwave Filters, Impedance Matching Networks, and Coupling Structures", McGraw-Hill Book Company, New York, 1964. Reprinted by Artech House, 1980. The guided wavelength at the center frequency is given by:

$$\lambda_{g0} = \frac{\lambda_0}{\sqrt{1 - (\lambda_0/2a)^2}}$$

where λ0 is the free-space wavelength at the center frequency $f0$, a is the wider dimension of the waveguide. We can calculate the K-inverter parameters Kj,j+1 by the following mathematical analysis:

$$\frac{K_{01}}{Z_0} = \sqrt{\frac{\pi}{2} \cdot \frac{\omega_a}{g_0 g_1}}$$

$$\frac{K_{j,j+1}}{Z_0} = \frac{\pi\omega_a}{2} \cdot \frac{1}{\sqrt{g_j g_{j+1}}} \quad j = 1, \ldots, n-1$$

$$\frac{K_{n,n+1}}{Z_0} = \sqrt{\frac{\pi}{2} \cdot \frac{\omega_n}{g_n g_{n+1}}}$$

where g0 to gn+1 are the lowpass prototype element values, $\omega_a$ is the number of cavities and $$\omega_a = \left(\frac{\lambda_{g0}}{\lambda_0}\right)^2 \cdot \frac{\Delta f_g}{f_0}$$

$\Delta f$ is the filter bandwith.

From the K-inverter values we can calculate the normalized shunt reactance $X_p/Z_0$ $$\frac{X_{pj}}{Z_0} = \frac{K_{j-1,j}/Z_0}{\left[1 - \left(\frac{K_{j-1,j}}{Z_0}\right)^2\right]}$$

The length of each resonator is then given by $l_j$ where:

$$\left(\frac{2\pi}{\lambda_{go}}\right) l_j = \theta_j' + \frac{1}{2}(\Phi_j + \Phi_j + 1)$$

$$\Phi_j = -\tan^{-1}\left(\frac{2X_{pj}}{Z_0}\right)$$

$$\theta_j' = \pi, j = 1, 2, \ldots, n$$

Figure 4:
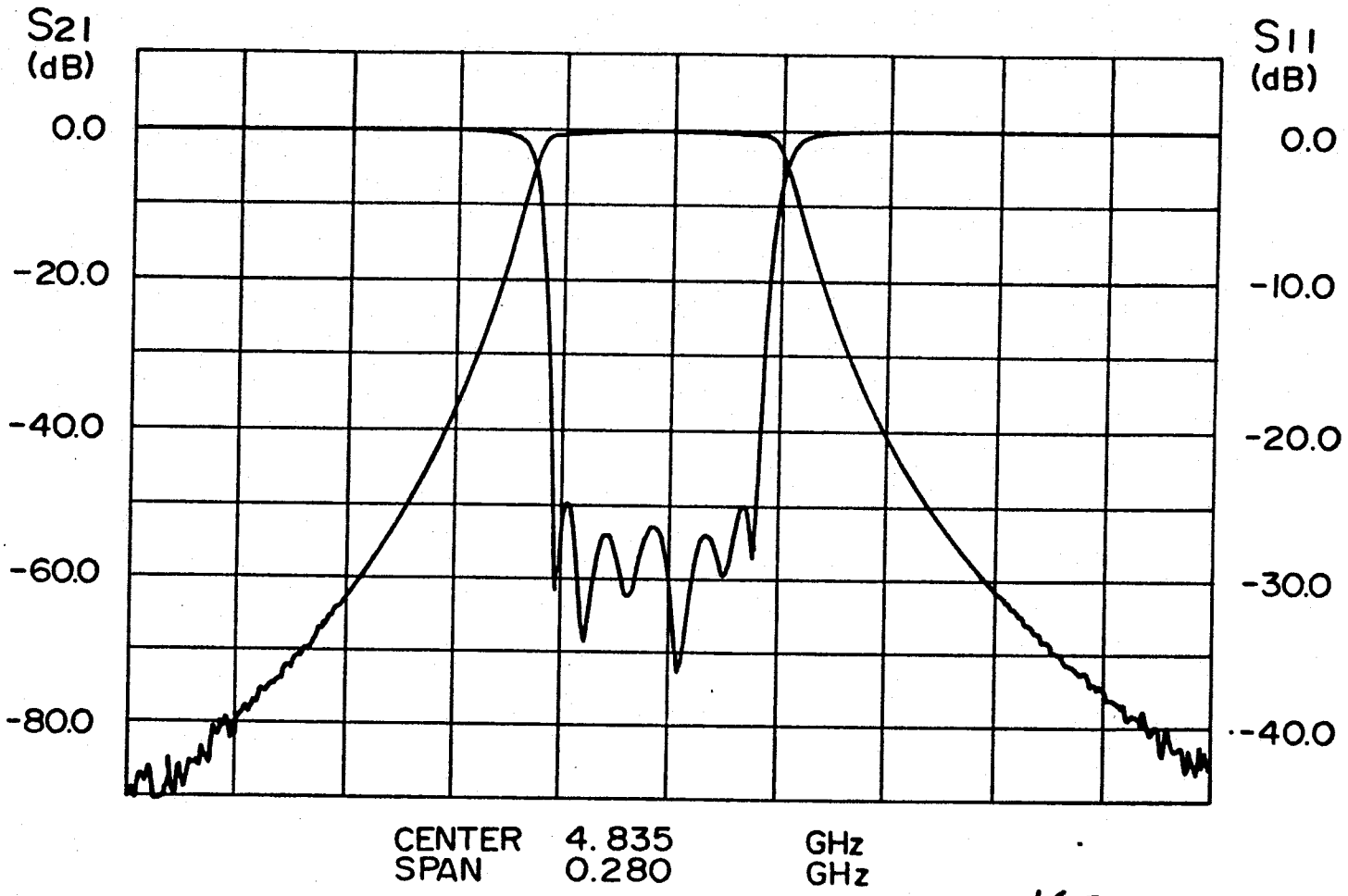
FIG. 4 is a graph showing a typical six-cavity folded filter response.

A 4.8 GHz six-cavity folded filter was designed, built and tested. Its frequency response is shown in FIG. 4. With a bandwidth of 52 MHz, the measured insertion loss was 0.34 dB at the center frequency. In temperature variation from 0° to +50° C., we could notice a frequency shift of about 200 KHz, but no changes in return loss or insertion loss performance was observed.

The superposed constructed folded filter of this invention has very competitive performances compared to a standard waveguide filter with half its total length.

It is within the ambit of the present invention to cover any obvious modifications of the preferred embodiment described herein, provided such modifications fall within the scope of the appended claims.

I claim:

1. A temperature stable folded waveguide bandpass filter of reduced length comprising two straight waveguide sections of rectangular cross-section, at least one of said sections has opposed parallel sidewalls and opposed parallel broadwalls, the other of said sections having opposed parallel side walls and at least one outer broadwall, one end of each said section being an open end and the opposite end closed by an end wall, connecting means adjacent said open end, each said waveguide section having transverse slits formed in their respective sidewalls and an outer broadwall at predetermined locations to receive therein shunt inductive iris plates and cavity wall plates to form resonating cavities in both said waveguide sections, said waveguide sections being interconnected superposed along an inner coupling broadwall of at least one of said sections thereof with said open end of each waveguide section disposed at opposed ends, said inner coupling broadwall of at least one of said waveguide sections having inductive coupling holes, and means to tune the frequency of said resonating cavities.

2. A temperature stable folded waveguide bandpass filter of reduced length comprising two straight waveguide sections of rectangular cross-section each defined by opposed parallel side walls and opposed parallel broadwalls, one end of each said section being an open end and the opposite end closed by an end wall, connecting means adjacent said open end, each said waveguide section having transverse slits formed in their respective sidewalls and broadwalls at predetermined locations to receive therein shunt inductive iris plates and cavity wall plates to form resonating cavities in both said waveguide sections, said waveguide sections being interconnected superposed along a coupling broadwall thereof with said open end of each waveguide section disposed at opposed ends, said coupling broadwall of each waveguide section having inductive coupling holes, said coupling holes in said coupling broadwall of each waveguide section being juxtaposed when said waveguide sections are interconnected, and means to tune the frequency of said resonating cavities.

3. A folded waveguide bandpass filter as claimed in claim 2 wherein said iris and cavity wall plates are soldered or brazed in position along said slits, said coupling broadwall of said waveguide sections being soldered or brazed together.

4. A folded waveguide bandpass filter as claimed in claim 3 wherein said iris and cavity walls are made from INVAR (registered trademark) metal to achieve temperature stability and material compatibility with said waveguide sections.

5. A folded waveguide bandpass filter as claimed in claim 4 wherein said end wall of each said waveguide section is formed from INVAR metal.

6. A folded waveguide bandpass filter as claimed in claim 2 wherein said coupling holes are elongated rectangular holes having rounded ends, said holes being positioned and having a predetermined size calculated to achieve proper inductive coupling for the bandpass filter.

7. A folded waveguide bandpass filter as claimed in claim 2 wherein each waveguide section defines three cavities in the space defined between said end wall and an intermediate cavity wall plate and the space defined between said intermediate cavity wall plate and said open end, said two cavities being delineated by the position of one of said iris plates, said cavity defined between said iris plate and said intermediate cavity wall in said space between said end wall and intermediate cavity wall having two coupling holes in their broadwall.

8. A folded waveguide bandpass filter as claimed in claim 7 wherein said two waveguide sections are substantially identical waveguide sections.

9. A folded waveguide bandpass filter as claimed in claim 2 wherein said waveguide sections have inner wall surfaces of their side walls and broadwalls plated with copper or other precious metal.

10. A folded waveguide bandpass filter as claimed in claim 2 wherein said means to tune the frequency of said resonating cavities is comprised by tuning screws extending within said side walls.

11. A method of constructing a temperature-stable folded waveguide filter of reduced length while maintaining the performance of a straight waveguide filter which is substantially longer, said method comprising the steps of:

(i) providing two straight waveguide sections of rectangular cross-section and at least one having opposed parallel sidewalls and opposed parallel exterior and interior broadwalls and the other having opposed parallel sidewalls and at least said exterior broadwall, one end of each said section being an open end and the opposite end closed by an end wall, connecting means adjacent said open end;

(ii) forming transverse slits in the respective sidewalls and said exterior broadwalls of said waveguide sections at predetermined locations;

(iii) securing shunt inductive iris plates and cavity wall plates in said slits to form resonating cavities in both said waveguide sections;

(iv) forming inductive coupling holes in said interior broadwall of at least the waveguide section having opposed broadwalls at predetermined positions;

(v) interconnecting said waveguide sections by superimposing said waveguide sections in a predetermined manner with the outermost of said exterior broadwalls and connecting them together with said open end of each sections at an opposed end.

12. A method as claimed in claim 11 wherein each waveguide section has opposed broadwalls, said coupling holes being formed in both said interior broadwalls, said sections being connected with their interior broadwalls superimposed with their coupling holes aligned.

13. A method as claimed in claim 11 wherein there is further provided the step of (vi) tuning the frequency of said resonating cavities by adjusting tuning elements provided in said sidewalls and broadwalls.

14. A method as claimed in claim 13 wherein said step (iii) comprises soldering or brazing said inductive iris plates and cavity wall plates along said slits, said plates extending transversely within said waveguide section and terminating in an unobstructive manner with an outer face of said waveguide sections.

15. A method as claimed in claim 14 wherein said step (v) comprises soldering or brazing said coupling broadwalls in superposed position with said holes of both said waveguide sections aligned.

16. A method as claimed in claim 11 wherein said end wall of each said waveguide section is formed by soldering or brazing a plate of INVAR metal at an end of an open-ended waveguide tube.

17. A method as claimed in claim 11 wherein there is further provided the step of securing waveguide attachment means in relation to said open end of each said waveguide section.

* * * * *